US005804788A

United States Patent [19]

Smith

[11] Patent Number: 5,804,788

[45] Date of Patent: Sep. 8, 1998

[54] CYLINDRICAL COIL AND CONTACT SUPPORT FOR VACUUM INTERRUPTER

[75] Inventor: Robert Kirkland Smith, Ithaca, N.Y.

[73] Assignee: Eaton Corporation, Cleveland, Ohio

[21] Appl. No.: 801,321

[22] Filed: Feb. 18, 1997

Related U.S. Application Data

[63] Continuation of Ser. No. 340,578, Nov. 16, 1994, abandoned.

[51] Int. Cl.[6] ..... H01H 33/66

[52] U.S. Cl. ..... 218/129; 218/128

[58] Field of Search ..... 218/118, 123–129

[56] References Cited

U.S. PATENT DOCUMENTS

| | | | |
|---|---|---|---|
| 3,823,287 | 7/1974 | Bettge | 200/144 B |
| 4,260,864 | 4/1981 | Wayland et al. | 200/144 B |
| 4,588,879 | 5/1986 | Noda et al. | 200/144 B |
| 4,675,483 | 6/1987 | Gebel et al. | 200/144 B |
| 4,704,506 | 11/1987 | Kurosawa et al. | 200/144 B |
| 4,839,481 | 6/1989 | Nash et al. | 200/144 B |
| 4,871,888 | 10/1989 | Bestel | 200/144 B |
| 4,982,059 | 1/1991 | Bestel | 200/144 B |
| 5,055,639 | 10/1991 | Schels et al. | 200/144 B |
| 5,313,030 | 5/1994 | Kusserow et al. | 200/144 B |
| 5,438,174 | 8/1995 | Slade | 218/118 |
| 5,612,523 | 3/1997 | Hakamata et al. | 218/132 |

OTHER PUBLICATIONS

Slade, P. G., "The Vacuum Interrupter Contact", Mar., 1984, pp. 25–32.

IEEE Transactions on Components, Hybrids, and Manufacturing Technology, vol., CHMT–7, No. 1, Mar. 1984.

*Primary Examiner*—Cassandra C. Spyrou
*Assistant Examiner*—Michael A. Friedhofer
*Attorney, Agent, or Firm*—Martin J. Moran

[57] ABSTRACT

A vacuum interrupter includes a pair of separable electrode assemblies within a vacuum envelope, each electrode assembly including a contact confronting the contact of the other electrode assembly and an electrode coil assembly located behind the contact for generating a magnetic field in a region between the contacts. The electrode coil assembly, which is energized by an a.c. current in the interrupter, includes a generally annular-shaped member having a plurality of slots extending radially between a peripheral surface and an interior surface, the slots defining a substantially circumferential current path. The slots include an axially extending slot and a circumferentially extending slot that define a coil. The electrode coil member is connected in series between a terminal post and the contact of the electrode assembly. The electrode coil assembly also can include a tubular support for the contact.

20 Claims, 4 Drawing Sheets

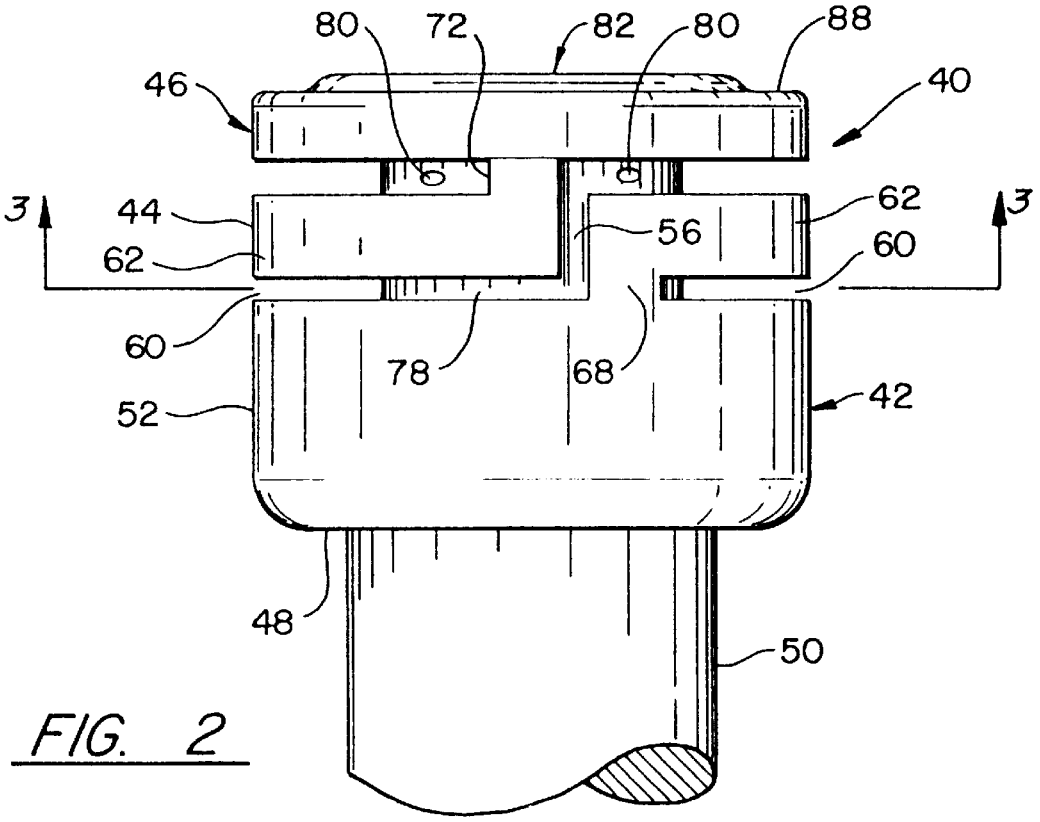
FIG. 2
FIG. 3
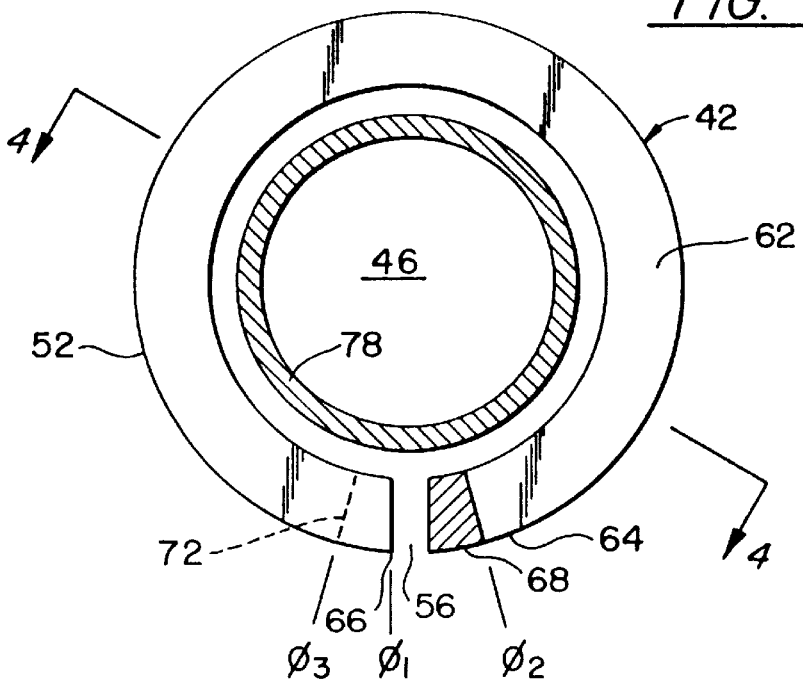

CYLINDRICAL COIL AND CONTACT SUPPORT FOR VACUUM INTERRUPTER

This application is a continuation of application Ser. No. 08/340,578, filed Nov. 16, 1994 now abandoned.

CROSS REFERENCE TO RELATED APPLICATION

This application is related to commonly assigned application Ser. No. 08/155,355, filed on Nov. 22, 1993, by Paul Slade, entitled VACUUM INTERRUPTER WITH A RADIAL MAGNETIC FIELD.

BACKGROUND OF THE INVENTION

1. Field of the Invention

The invention relates to the field of vacuum interrupters, and in particular concerns an electrode assembly having a cylindrical coil structure and contact support for producing a magnetic field.

2. Description of the Prior Art

Vacuum interrupters of different sizes and designs are typically used to interrupt high voltage a.c. currents of a several hundred amperes to 30,000 amperes and more. Each typically includes a generally cylindrical vacuum envelope surrounding a pair of coaxially aligned, separable contact assemblies having opposing contact surfaces that abut one another in a closed circuit position and are separated to open the circuit. Each electrode assembly is connected to a current carrying terminal post extending outside the vacuum envelope and connecting to an a.c. circuit.

An arc is typically formed between the contact surfaces when the contacts are moved apart to the open circuit position. The arcing continues until the current is interrupted. Metal from the contacts that is vaporized by the arcing forms a neutral plasma during arcing and condenses back onto the contacts and also onto vapor shields placed intermediate the contact assemblies and the vacuum envelope after the current is extinguished.

The arc generally is initially in a compact, columnar form that creates a hot plasma. A hot plasma can support a significant current between the contacts, and therefore make the current more difficult to interrupt. It is advantageous to encourage the columnar arc to become a diffuse arc, leading to a cooler plasma and a more easily interrupted current. A diffuse arc, because it distributes the arc energy over a broader area of the contact surface, does not vaporize as much of the contact as does a columnar arc, and thereby extends the useful life of the contacts and the interrupter.

One technique of encouraging formation of a diffuse arc is by imposing an axially directed magnetic field in the region between the contacts. The field can be self generated by the interrupter current in coils located behind each contact. A variety of electrode assemblies incorporating such coils for axial magnetic field vacuum interrupters are discussed in the article entitled *"The Vacuum Interrupter Contact"* by Paul Slade, IEEE Trans. on Components, Hybrids, and Mfg. Tech., Vol. CHMT-7, No. 1, March 1987.

Prior art field coils, such as the coil disclosed in U.S. Pat. No. 4,260,864, typically include current carrying arms radiating from a central hub, the radial arms connecting to arcuate coil elements. The radial arms generate fields having a significant component that is not in the axial direction. The non-axial fields can perturb the arc and delay transition of the arc to the diffuse state. In addition, the radial arms add significantly to the total length of the current path. This adds a resistive heat load to the interrupter that may have to be compensated for by unwanted design modifications. The non-axial fields produced by current carrying elements other than the arcuate coil elements can also create eddy currents in the contacts which create fields opposing the axial field, reducing the effectiveness of the coil elements.

Some axial field vacuum interrupter designs, such as those disclosed in U.S. Pat. Nos. 4,871,888 and 4,982,059, have attempted to reduce or eliminate the radially extending portions of the coils by using cylindrical coils having a plurality of angled slots, the angled slots defining a plurality of helically extending current carrying arms. The helical arms typically result in a current path that is not as effective in producing a large axial field as are purely circumferentially extending coil elements. The helical current path extends significantly in the axial direction behind the contact, in effect moving the coil farther from the contact. Both types of prior art electrode assembly designs typically have several pieces, thereby imposing high parts and construction costs.

It is therefore desirable to obtain an electrode assembly for a vacuum interrupter having a coil structure that includes no radially extending arms, that includes a minimum of parts and that is simple to construct.

SUMMARY OF THE INVENTION

It is an object of the invention to provide an electrode coil for providing a magnetic field to the contact region of a vacuum interrupter when energized by a current in the vacuum interrupter.

It is another object of the invention to provide an electrode coil for an axial field vacuum interrupter that does not include any radially extending arms that carry electric current.

It is another object of the invention to provide an electrode coil for a vacuum interrupter that does not generate excessive resistive heat.

It is another object of the invention to provide a low cost electrode assembly for producing a magnetic field in a vacuum interrupter, that includes a minimum of parts and is simple to construct.

These and other objects are obtained by an electrode, or contact coil assembly for a vacuum interrupter. Vacuum interrupters generally include a vacuum envelope, first and second terminal posts for connecting to an a.c. circuit and first and second separable contacts within the vacuum envelope electrically coupled to the first and second terminal posts, respectively, the contacts each including a front side confronting the front side of the other contact and a back side spaced from the front side. The contact coil assembly includes a generally annular-shaped member having a generally cylindrical peripheral surface, a generally cylindrical interior surface, a first end, a second end, and a plurality of slots extending between the interior and peripheral surfaces and defining a substantially circumferential current path. The contact coil assembly also includes first means for electrically coupling the first end of the annular-shaped member to the first contact and second means for rigidly coupling the second end of the annular-shaped member to the first terminal post. When energized by current in the interrupter, the circumferential current path produces a preferably axially directed magnetic field in the region between the contacts.

According to another aspect of the invention, the slots include a first slot at a first polar angle and extending in an axial direction from the first end to a first axial position located between the first and second ends, and a second slot at the second axial position extending in an angular direction from the first polar angle to a second polar angle spaced from the first polar angle, the first and second slots defining a first coil that includes a free end.

According to another aspect of the invention, the contact coil assembly further includes a tubular support, fabricated of a material having an electrical resistance significantly greater than the electrical resistance of the first coil, including one end for coupling to a portion the inner radial surface of the annular-shaped member between the first axial position and the second end of the member, and an other end for rigidly fixing to the back side of the first contact.

According to other aspects of the invention, the first means includes an electrically conductive connector post projecting in an axial direction from the free end of the first coil and connecting to the first contact, and the second means includes structure defined by the interior surface, comprising an annular shoulder providing a stop surface for the first terminal post at a second axial position located between the first axial position and the second end of the annular-shaped member.

The invention also provides an electrode coil for electrically coupling a terminal post to a contact in a vacuum interrupter, fabricated by the steps of: providing a cylindrical metal tube that includes first and second ends, a peripheral surface, and an interior surface having a first radius; boring the interior surface to a second radius from the second end to a stop surface at a first axial position for insertion of the terminal post up to the stop surface; boring the interior surface to a third radius from the first end to a second axial position approaching the first axial position; cutting a first circumferential slot at about the second axial position from a first angular position $\phi_1$ to a second angular position $\phi_2$ and from the peripheral surface to the third radius; and cutting a first axial slot from the first end to the first circumferential slot and from the peripheral surface to the third radius at the first angular position $\phi_1$.

The foregoing objects and aspects of the invention will be more fully understood from the following description of the invention with reference to exemplary embodiments as illustrated in the drawings appended hereto.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIG. 2 is a side view of an embodiment of an electrode assembly according to the invention.

FIG. 3 is a sectional view through line 3—3 of FIG. 2.

DETAILED DESCRIPTION OF THE PREFERRED EMBODIMENTS

Figure 1:
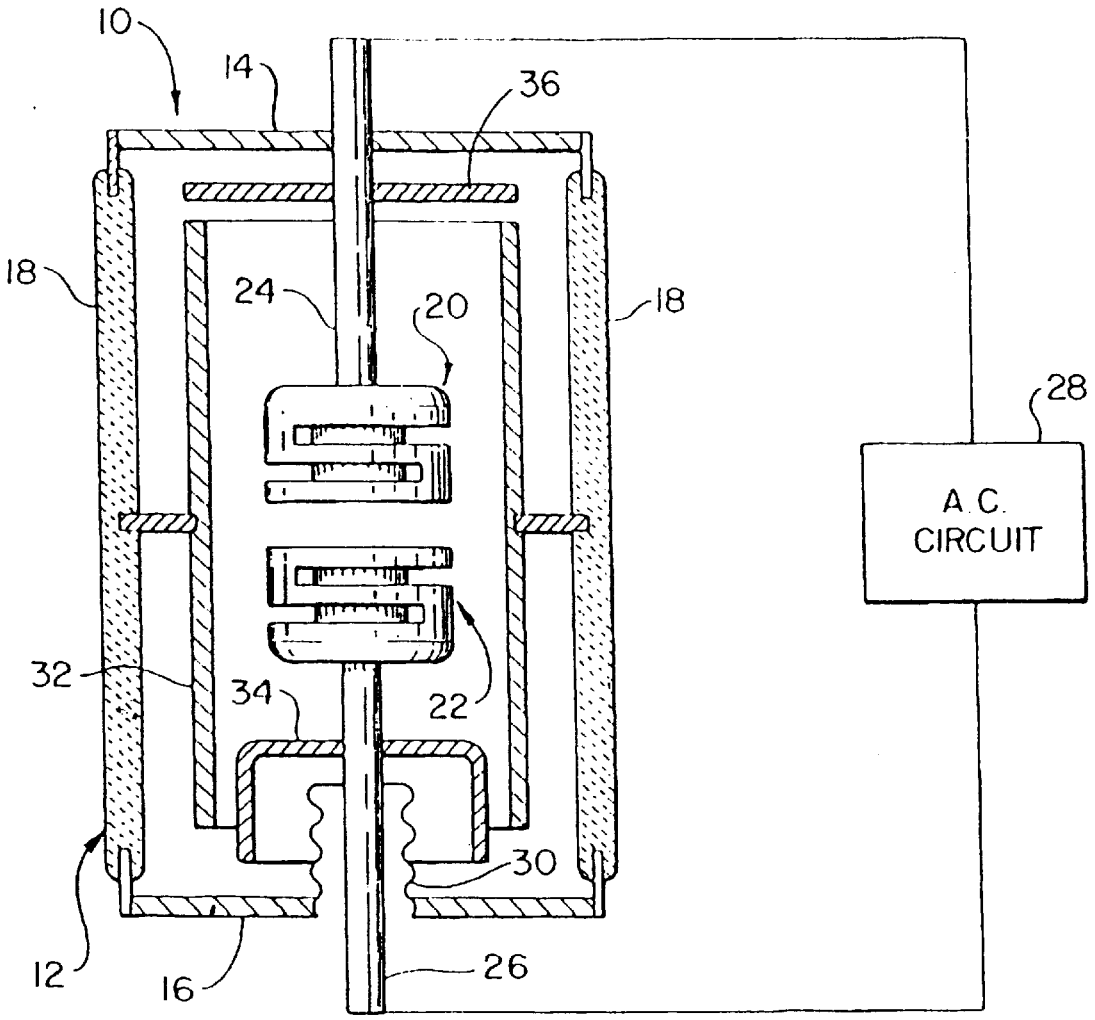
FIG. 1 is a partial sectional view of a vacuum interrupter according to the invention.

Referring now to FIG. 1, a vacuum interrupter 10 according to the invention includes a vacuum envelope 12 having a spaced, conducting end caps 14, 16 joined by a tubular, insulating casing 18, first and second electrode assemblies 20, 22 defining a common longitudinal axis within the vacuum envelope 12, first and second terminal posts 24, 26 electrically coupled to the first and second electrode assemblies 20, 22, respectively, for coupling the first and second electrode assemblies 20, 22 to an a.c. circuit 28, and a mechanism, such as, for example, a bellows assembly 30, permitting movement of at least one of the electrode assemblies axially of the other between an open circuit position and an in series closed circuit position (not shown). A vapor shield 32 that is either electrically isolated from the electrode assemblies 20, 22 or connected to only one of the electrode assemblies 20, 22 surrounds both electrode assemblies 20, 22 to keep metal vapors from collecting on the insulating casing 18. A bellows vapor shield 34 keeps metal vapors off the bellows assembly 30 and end cap 14 and an additional vapor shield 36 protects the other end cap 16.

Figure 4:
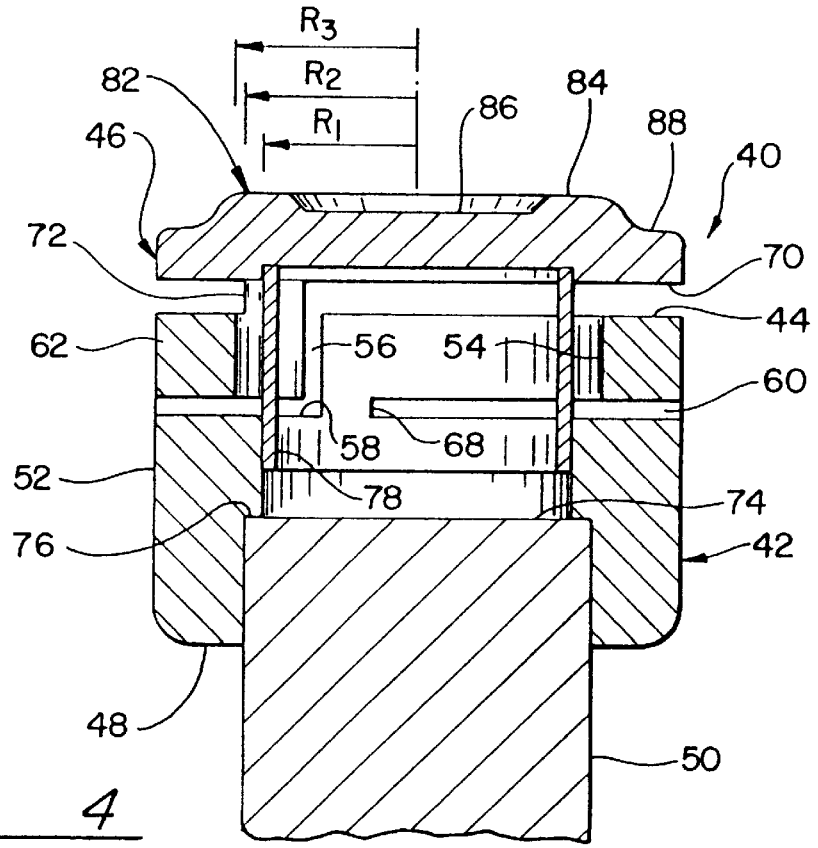
FIG. 4 is a sectional view through line 4—4 of FIG. 3.

The first and second electrode assemblies 20, 22 have component parts that are common to both, therefore, it will be understood that the following description of preferred electrode assembly embodiments describe components common to each electrode assembly in a vacuum interrupter. FIG. 2 is a side elevation view of a preferred embodiment of an electrode assembly 40 according to the invention, FIG. 3 is a sectional view through the electrode assembly 40, and FIG. 4 is a longitudinal section through the electrode assembly 40. Electrode assembly 40 includes a generally annular-shaped electrode coil member 42 which includes a first end 44 electrically connected to a substantially disc-shaped electrode, or contact 46, a second end 48 electrically connected to a terminal post 50, a peripheral surface 52, and an interior surface 54 having a minimum first radius $R_1$. An axial slot 56 extends between the interior surface 54 and the peripheral surface 52 and extends in an axial direction from the first end 44 to a first axial position 58 at about a first polar angle $\phi_1$, as best illustrated in FIG. 3. A circumferential slot 60 that is located at the first axial position 58 extends between the interior surface 54 and the peripheral surface 52, and extends in an angular direction from the first polar angle $\phi_1$ to a second polar angle $\phi_2$ substantially spaced from $\phi_1$. The axial slot 56 and the circumferential slot 60 together define a coil 62 extending circumferentially from a first coil end 64 at about $\phi_2$ to a second coil end 66 at about $\phi_1$, almost 360° apart.

The axial slot 56 and the circumferential slot 60 also define a conducting first connector post 68 that projects in an axial direction between the second end 48 of the electrode coil member 42 and the first coil end 64. The coil 62 is electrically coupled to a rear surface 70 of the contact 46 by a conducting second connector post 72 that projects in an axial direction from the second coil end 66.

The electrode coil member 42 is preferably fabricated from a single piece of highly conductive material, such as copper. Each of the slots 56, 60 can be formed by saw cuts. The second conducting connector post 72 can be formed by cutting back the first end 44 of the electrode coil member 42 between the first polar angle $\phi_1$ and a third polar angle $\phi_3$ by appropriate machining methods, such as with a milling operation or with a saw cut.

The terminal post 50 connects to the electrode coil member 42 at a second axial position 74 proximate the second end 48 and spaced from the first axial position 58. The interior surface 54 is preferably bored out to a second radius $R_2$ from the second end 48 to define a shoulder 76 providing a stop surface for the terminal post 50 at the second axial position 74.

Electrode assembly 40 also preferably includes a tubular support 78 fabricated such as to have an electrical resistance that is significantly greater than the electrical resistance of the electrode coil member 42. The tubular support 78 is located within the central opening of the electrode coil member 42 and supports the contact 46. The outer surface of the tubular support 78 preferably fits snugly against a portion of the interior surface 54 of the electrode coil member 42, one end fitting into a recess in the rear surface 70 of the contact 46. The interior surface 54 of the electrode coil member 42 is preferably bored out to a third radius $R_3$ from the first end 44 to the first axial position 58 such that the tubular support 78 does not contact the coil 62 directly.

The electrode coil member 42, the terminal post 50, the contact 46 and the tubular support 78 can be permanently joined together by oven brazing or other well known methods. The tubular support 78 preferably includes one or more vent holes 80 for permitting the escape of gases during brazing and to permit quick evacuation of the vacuum interrupter.

The contact 42 is preferably symmetric about its longitudinal axis and preferably is of a non-slotted design. A preferred type of contact for use with the invention has a front side 82 that includes an annular contacting surface 84, a central dimple 86 and a peripheral step recess 88 radially outside the contacting surface 84.

Figure 6:
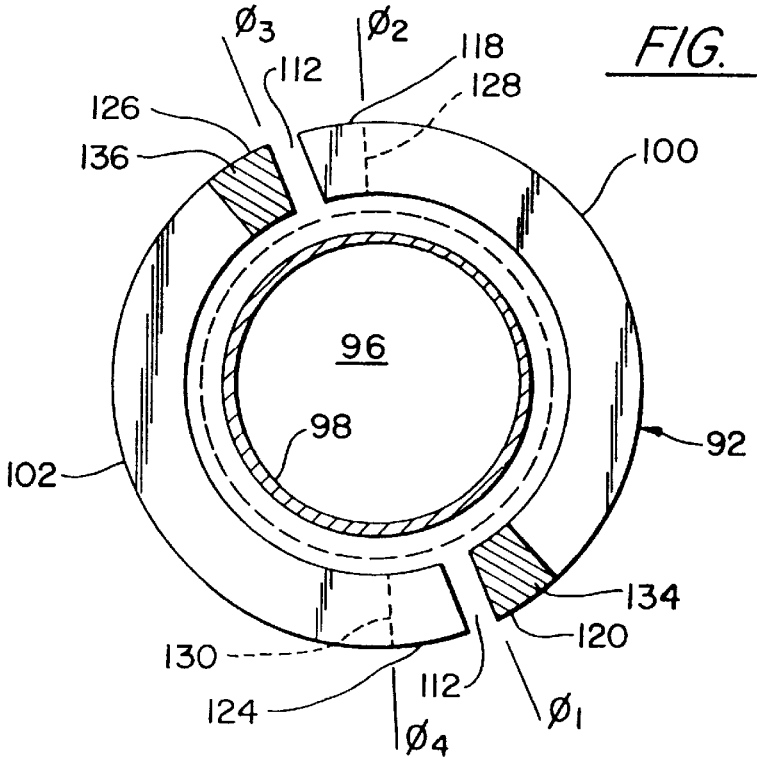
FIG. 6 is a sectional view through line 6—6 of FIG. 5.
Figure 5:
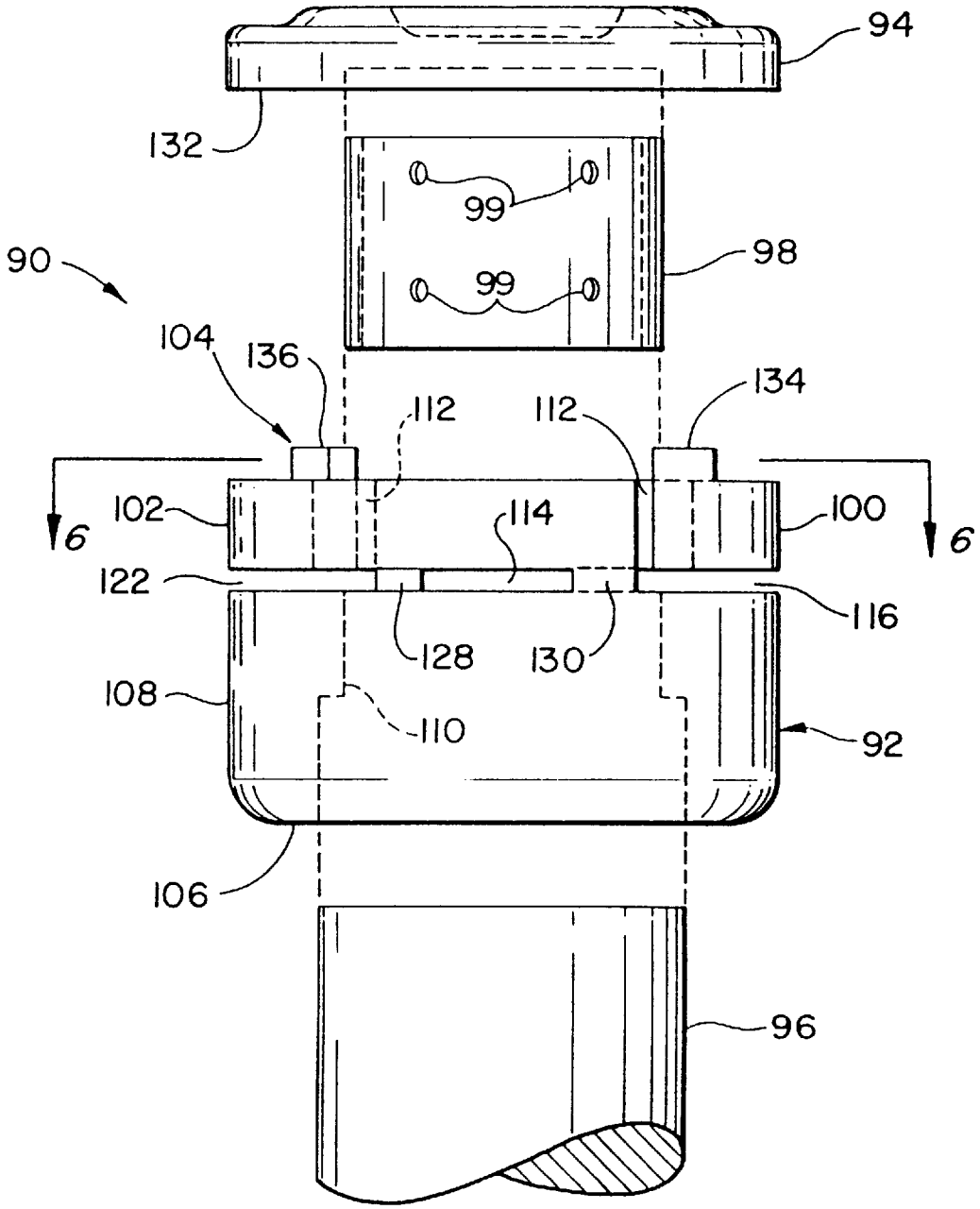
FIG. 5 is an exploded side view of an electrode assembly according to a second embodiment of the invention.

A second embodiment of an electrode assembly 90 of the invention is similar in most respects to electrode assembly 40 described hereinbefore, and is shown in an exploded view in FIG. 5 and in sectional view in FIG. 6. The electrode assembly 90 includes a generally annular-shaped electrode coil member 92 electrically coupling between a contact 94 and a terminal post 96, and a tubular support 98 having vent holes 99. However, this embodiment of the electrode coil member 42 includes first and second coils 100, 102 that each extend circumferentially almost 180°, instead of a single coil that extends almost 360° as in electrode assembly 40. This type of electrode coil member 92 has the advantage of dividing the interrupter current in the electrode coil member between two circumferential current paths, i.e, the two coils 100, 102, each having a shorter path length than the single coil of electrode assembly 40, thereby reducing resistive heating generated by current in the electrode coil member 92 significantly. The electrode assemblies 20, 22 illustrated in FIG. 1 also each include a pair of circumferential coils.

Electrode coil member 92, which is preferably fabricated of a single piece of conductive material, includes a first end 104 connecting to the contact 94, a second end 106 connecting to the terminal post 96, a peripheral surface 108, an interior surface 110, an axial slot 112 extending diametrically across the electrode coil member 92 and extending in an axial direction from the first end 104 to a first axial position 114. A first circumferential slot 116 at the first axial position 114 extends radially between the interior surface 110 and the peripheral surface 108 and extends circumferentially in an angular direction from the axial slot 112 at a first polar angle $\theta_1$ to a second polar angle $\theta_2$ spaced about 160°–165° from $\theta_1$ such that the axial slot 112 and the first circumferential slot 116 define the first coil 100, the first coil 100 extending circumferentially from a first end 118 at about $\theta_2$ to a second end 120 at about $\theta_1$.

A second circumferential slot 122 at the first axial position 114 extends radially between the interior surface 110 and the peripheral surface 108, and extends circumferentially in an angular direction from the axial slot 112 at a third polar angle $\theta_3$ to a fourth polar angle $\theta_4$ spaced about 16°–165° from $\theta_3$ such that the axial slot 112 and the second circumferential slot 122 define the second coil 102, the second coil 102 extending circumferentially from a first end 124 at about $\theta_4$ to a second end 126 at about $\theta_3$. Thus, the first coil 100 and the second coil 102 each define a circumferential current path that is less than 180° long The first ends 118 and 124 of the first and second coils 100 and 102, respectively, are electrically coupled to the second end 106 of the electrode coil member 92 by posts 128 and 130, respectively, which are defined by the axial slot 112 and the first and second circumferential slots 116, 122. The second ends 120, 126 of the first and second coils 100, 102, respectively, are electrically coupled to the rear side 132 of the contact 94 by posts 134, 136, respectively.

While the preferred embodiments discussed hereinabove include one or two circumferential coils in each electrode assembly, electrode assemblies that each include more than two circumferential coils are also encompassed by the invention.

In a preferred arrangement, the electrode coils of two opposing electrode assemblies can be structured to cooperatively generate a generally dipole magnetic field when energized by an electric current in the electrode coils, the magnetic field being substantially axially directed in a region between contacting surfaces when the contacts are separated. A dipole field is obtained by arranging the coils such that current flows in the same angular direction through each coil of each electrode assembly. Such an arrangement is illustrated in FIG. 1. The axially directed field in the region between the contacting surfaces encourages the formation of a diffuse arc which is more easily extinguished than a columnar arc.

Alternatively, the electrode coils can be structured to generate a generally quadrupole magnetic field when similarly energized by an electric current in the electrode coils, the magnetic field being substantially radially directed in a region between the contacting surfaces when the contacts are separated. This result is obtained by arranging the coils such that current flows in opposite angular directions through the coils of the two opposing electrode assemblies.

Although it is preferred that each electrode assembly include an electrode coil member and tubular support as hereinabove discussed, it is also contemplated by the invention that a vacuum interrupter may include such an electrode coil member and support in only one of the electrode assemblies.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A contact coil assembly for an axial magnetic field vacuum interrupter which includes a vacuum envelope, first and second terminal posts for connecting to an a.c. circuit and first and second separable contacts within the vacuum envelope electrically coupled to the first and second terminal posts each having a longitudinal axis, respectively, the contacts each including a front side confronting the front side of the other contact and a back side spaced from the front side, the contact coil assembly comprising:

a generally annular-shaped member including a plurality of slots extending from an interior surface to a peripheral surface and oriented substantially in parallel with said longitudinal axis of said first and second terminal parts, said slots defining a current path extending in a substantially circumferential direction less than 360° around the generally annular-shaped member:

first means for electrically coupling a first end of the annular-shaped member to the first contact; and second means for rigidly coupling an annular second end of the annular-shaped member to the first terminal post said annular second end of the annular-shaped member comprising a substantially cylindrical inner surface coupled to a substantially cylindrical outer surface of the first terminal post, said second means being substantially solid between said terminal post and said annular-shaped member, said annular-shaped member having an axial length, said second means having a radial dimension, said axial length being substantially larger than said radial dimension.

2. The contact coil assembly of claim 1, wherein said slots comprise a first slot at a first polar angle and extending in an axial direction from the first end to a first axial position located between the first and second ends, and a second slot at the first axial position extending in a circumferential direction from the first polar angle to a second polar angle spaced from the first polar angle, wherein the first and second slots define a first coil that includes a free end.

3. The contact coil assembly of claim 2, wherein the contact coil assembly further comprises a tubular support having an electrical resistance significantly greater than the electrical resistance of the first coil, including one end for coupling to a portion of an interior surface of the member between the first axial position and the second end of the member, and an other end for rigidly fixing to the back side of the first contact.

4. The contact coil assembly of claim 3, wherein the first means includes a conductive connector post projecting in an axial direction from the free end of the first coil and connecting to the first contact.

5. The contact coil assembly of claim 3, wherein the second means includes structure defined by the interior surface, comprising an annular shoulder providing a stop surface for the first terminal post at a second axial position located between the first axial position and the second end of the member.

6. The contact coil assembly of claim 3, wherein the first coil includes an arc segment that is significantly greater than 180°.

7. The contact coil assembly of claim 3, wherein said slots comprise a third slot at a third polar angle spaced from the first polar angle and extending in an axial direction from the first end of the annular-shaped member to the first axial position, and a fourth slot at the first axial position extending in a circumferential direction from the third polar angle to a fourth polar angle spaced from the third polar angle, wherein the third and fourth slots define a second coil that includes a free end.

8. The contact coil assembly of claim 7, wherein the first and second coils each extend through an arc of almost 180°.

9. The contact coil assembly of claim 8, wherein the first means includes first and second conductive connector posts projecting in an axial direction from the free end of the first and second coils, respectively, and connecting to the first contact.

10. The contact coil assembly of claim 8, wherein the second means includes structure defined by the interior surface, comprising an annular shoulder providing a stop surface for the first terminal post at a second axial position located between the first axial position and the second end of the member.

11. A vacuum interrupter, comprising:

a vacuum envelope;

first and second electrode assemblies defining a common longitudinal axis within the vacuum envelope;

first and second terminal posts each having a longitudinal axis electrically coupled to the first and second electrode assemblies, respectively, for coupling the first and second electrode assemblies to an a.c. circuit;

first means permitting movement of at least one of the electrode assemblies axially of the other between an open circuit position and an in series closed circuit position;

wherein each of the first and second electrode assemblies include:

a contact having a contacting surface confronting the other contact and a rear surface spaced therefrom;

a generally annular-shaped electrode coil member defining a current path extending in a substantially circumferential direction less than 360° around the generally annular-shaped electrode coil member, comprising a first end proximate the contacts, an annular second end proximate the terminal post, a peripheral surface, an interior surface, and oriented substantially in parallel with said longitudinal axis of said first and second terminal parts, and extending in an axial direction from the first end to a first axial position at a first polar angle $\phi 1$, a circumferential slot at the first axial position extending radially between the interior surface and the peripheral surface and extending in an angular direction form $\phi 1$ to a second polar angle $\phi 2$ substantially spaced from $\phi 1$, said annular second end being substantially solid between said terminal post and said interior surface, said region between said terminal post and said interior surface having a radial dimension, said annular-shaped current member having an axial length which is substantially larger than said radial dimension, wherein the axial slot and the circumferential slot define a circumferential first coil extending from a first end at about $\phi 2$ to a second end at about $\phi 1$;

second means for electrically coupling the rear surface of the contact to the second end of the first coil; and third means for electrically coupling the terminal post to the electrode coil member at a second axial position proximate the annular second end of the electrode coil member and spaced from the first axial position, said annular second end of the annular-shaped electrode coil member comprising a substantially cylindrical inner surface rigidly coupled to a substantially cylindrical outer surface of the terminal post.

12. The vacuum interrupter according to claim 11, wherein each of the first and second electrode assemblies include a tubular support having an electrical resistance significantly greater than the electrical resistance of the electrode coil member, located within a central space defined by the interior surface for supporting the contact.

13. The vacuum interrupter according to claim 12, wherein each tubular support comprises one end for rigidly coupling to a portion of the interior surface between the first axial position and the second end of the electrode coil member, and an other end for rigidly fixing to the rear surface of the contact.

14. The vacuum interrupter according to claim 12, wherein the electrode coil member, the second means and the third means are fabricated from a single, machined piece of metal.

15. The vacuum interrupter according to claim 12, wherein the first and second electrode assemblies are structured to cooperatively generate a magnetic field being substantially axially directed in a region between the contacting surfaces when the contacts are separated.

16. The vacuum interrupter according to claim 12, wherein each electrode coil member further comprises a second axial slot extending radially between the interior surface and the peripheral surface and extending in an axial direction from the first end to the first axial position at a third polar angle $\phi_3$, a second circumferential slot at the first axial position extending radially between the interior surface and the peripheral surface and extending in a circumferential direction from $\phi_3$ to a fourth polar angle $\phi_4$ substantially spaced from $\phi_3$, wherein the second axial slot and the second circumferential slot define a circumferential second coil extending from a first end at about $\phi_4$ to a second end at about $\phi_1$.

17. The vacuum interrupter according to claim 16, wherein each of the first coil and the second coil extend through a polar angle of almost 180°.

18. The vacuum interrupter according to claim 12, wherein the first coil extends through a polar angle of almost 360°.

19. The vacuum interrupter of claim 14, wherein the second means comprises a connecting post axially projecting from the first coil proximate $\phi_1$ and connecting to the rear surface of the contact.

20. A method of producing a circumferential electrode coil for electrically coupling a terminal post with a longitudinal axis to a contact in a vacuum interrupter defining a current path extending in a substantially circumferential direction less than 360° around the circumferential electrode coil, fabricated by the steps of:

providing a generally cylindrical metal tube that includes first and second ends, a peripheral surface, and an interior surface having a first radius;

boring the interior surface a bore length to a third radius from the first end to a first axial position;

boring the interior surface to a second radius from the second end to a stop surface at a second axial position between the second end and the first axial position for insertion of the terminal post up to the stop surface, the difference between said second radius and said third radius being substantially less then said bore length;

cutting a first circumferential slot at about the first axial position from a first angular position $\phi$1 to a second angular position $\phi$2 and from the peripheral surface to the third radius; and cutting a first axial slot which is oriented substantially in parallel with said longitudinal axis of said terminal part from the first end to the first circumferential slot from the peripheral surface to the third radius at the first angular position $\phi$1.

* * * * *